United States Patent [19]

Vogel

[11] 4,055,212

[45] Oct. 25, 1977

[54] CONTROL SYSTEM AND METHOD FOR CONTROLLING THE OXYGEN CONTENT IN CONTINUOUSLY CAST METAL

[75] Inventor: Ralph A. Vogel, Three Rivers, Mich.

[73] Assignee: Essex Group, Inc., Fort Wayne, Ind.

[21] Appl. No.: 735,297

[22] Filed: Oct. 26, 1976

[51] Int. Cl.[2] ..... B22D 11/10; B22D 11/16

[52] U.S. Cl. ..... 164/4; 164/154; 164/437; 75/76; 75/93 E

[58] Field of Search ..... 73/61 LM; 75/76, 93 E; 164/4, 55, 76, 82, 154, 155, 273 R, 281, 335, 337

[56] References Cited

U.S. PATENT DOCUMENTS

| | | | |
|---|---|---|---|
| 3,189,956 | 6/1965 | Langden | 164/82 X |
| 3,785,427 | 1/1974 | DeBie | 164/154 |
| 3,884,680 | 5/1975 | DeBie | 75/76 X |

FOREIGN PATENT DOCUMENTS

| | | | |
|---|---|---|---|
| 45-14718 | 5/1970 | Japan | 73/61 LM |
| 46-32333 | 9/1971 | Japan | 75/76 |

*Primary Examiner*—Ronald J. Shore
*Attorney, Agent, or Firm*—Lawrence E. Freiburger; Robert D. Sommer

[57] ABSTRACT

A control system and method for controlling the oxygen content in continuously cast metal. The control system includes means for sensing the oxygen content of the molten metal at a first point upstream from the casting mold, either means for measuring the rate molten metal enters the casting mold or means for supplying molten metal to the casting mold at a constant rate, oxygen addition means for adding oxygen to the molten metal before it enters the casting mold, and control means for controlling the oxygen addition means in response to both the rate metal is supplied to the casting mold and the oxygen level of the molten metal at the first point. In the method of the invention, oxygen is added to the molten metal intermediate the first point and the casting mold in response to the oxygen content of molten metal at the first point and the rate molten metal enters the casting mold.

6 Claims, 1 Drawing Figure

CONTROL SYSTEM AND METHOD FOR CONTROLLING THE OXYGEN CONTENT IN CONTINUOUSLY CAST METAL

BACKGROUND OF THE INVENTION

In continuous casting systems for copper and other metals, the molten metal from the metal furnace is transferred to a holding furnace from which the metal flows into a tundish. Generally, the molten metal is withdrawn continuously from the tundish at a predetermined rate by a siphon which supplies the molten metal to the casting wheel.

One problem with continuous casting systems for copper as well as other metals is proper control of the oxygen content of the molten metal as it is siphoned away from the tundish. In copper, a certain amount of oxygen is necessary in order to render certain impurities less harmful and the amount of oxygen desired is fairly critical.

Until now, the oxygen content in copper was generally controlled by one of two methods. Firstly, it is possible to control the oxygen content in copper by controlling the oxidizing-reducing character of the hot gases generated by the melting furnace burners. This method has, however, proved to be a difficult method to practice because a very small change in the oxidizing-reducing character of the burner gases results in a substantial change in the oxygen content of the copper. In the second method, the melting furnace is operated so that the resulting molten copper is too low in oxygen content, and the proper amount of oxygen is added to the molten copper in the tundish. While the second method is generally satisfactory, a problem has arisen in determining the precise amount of oxygen to be added to the molten copper in the tundish. In the past the oxygen dissolved in the molten copper in the tundish was measured manually, by conventional methods whenever the operator deemed it necessary, and then the proper amount of air was added to bring the oxygen content to the desired level.

With the advent of the oxygen probe (a type of galvanic cell providing an EMF output which is proportional to the amount of oxygen dissolved in the copper) the process of measuring the oxygen content in molten copper was substantially simplified and shortened because the oxygen probe provides a substantially immediate indication of the measured oxygen content. However, the problem of how much oxygen to add to the copper remains.

SUMMARY OF THE INVENTION

Thus, it is an object of the present invention to provide a control system and method for controlling the oxygen content in continuous cast metal, particularly copper, on a continuous basis.

It is a further object of the present invention to provide a control system and method for controlling the oxygen in a continuous cast metal, particularly copper, on a continuous basis, in response to not only the actual oxygen content of the metal upstream from the casting mold but also the rate of supply of metal to the casting mold.

These and other objects of the invention will become apparent as the description of the invention proceeds.

Generally, the present invention includes oxygen measuring means for measuring the oxygen content of the molten metal at a first point up stream from the casting mold, oxygen addition means for adding oxygen to the molten metal intermediate the first point and the casting mold, and control means responsive to the flow rate of molten metal to the casting mold and the amount of oxygen in the molten metal at the first point for controlling the oxygen addition means.

DETAILED DESCRIPTION OF THE PREFERRED EMBODIMENT OF THE PRESENT INVENTION

Figure 1:
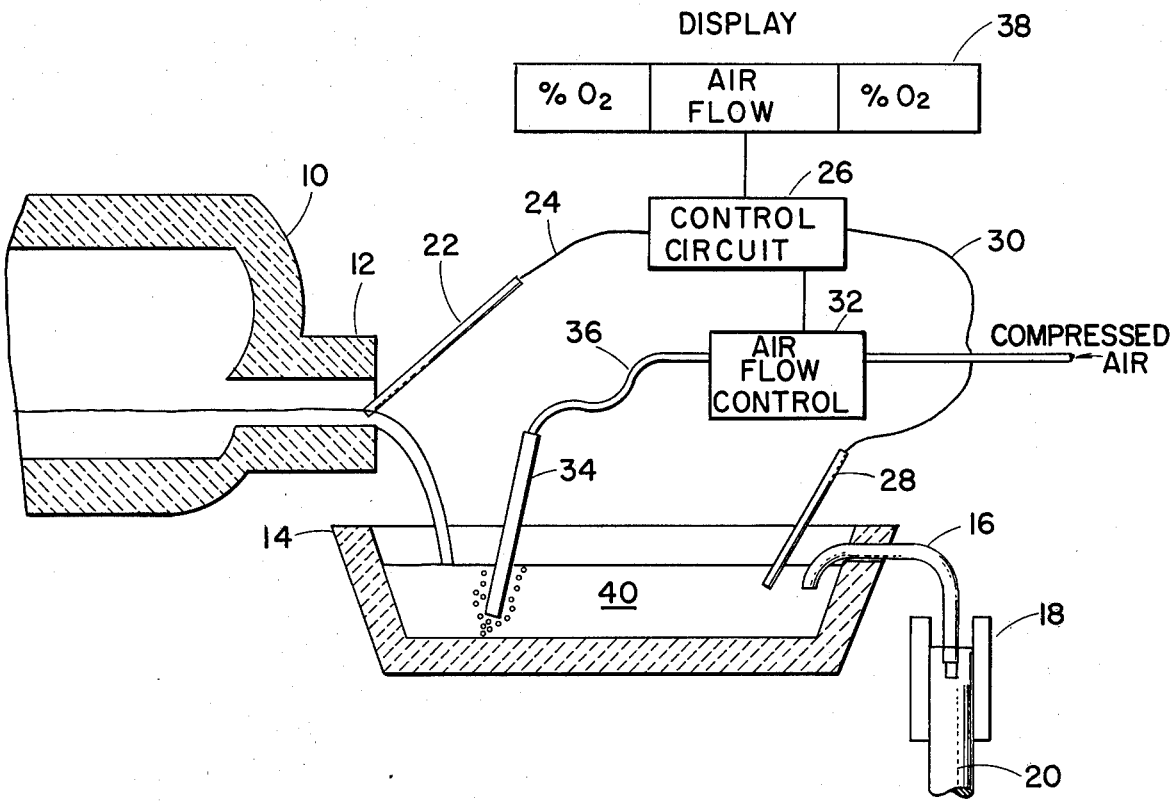
FIG. 1 is a partial schematic diagram of a continuous casting system and control system of the present invention.

Referring now to the drawing, a continuous casting system may include a holding furnace 10 which receives molten metal from a melting furnace (Not Shown). The outlet 12 of the holding furnace 10 is arranged to discharge molten metal into a tundish 14. For sake of clarity the lid has been omitted from the tundish but it will be clear to those skilled in the art that a lid is necessary. The tundish 14 has a siphon tube 16 associated with it which acts to withdraw molten metal from the tundish and supply it to a casting mold 18 as described in U.S. Pat. No. 3,670,799. The molten metal solidifies in the casting mold 18 to form a copper rod or bar 20 which is continuously withdrawn.

Until the present invention, the oxygen content of the molten copper being withdrawn from the tundish has been controlled by one of the above two described methods, namely, by controlling the melting furnace burners or by adding the desired amount of oxygen to the molten copper in the tundish by manual methods.

In accordance with the present invention, the melting furnace is operated so that the resultant molten copper is too low in oxygen content for continuous casting. A first oxygen probe 22 senses the oxygen level at a first point in the system and is situated to sense the oxygen level of the molten copper leaving the holding furnace or, alternately, is situated on the inlet side of the tundish. A leadwire 24 connects oxygen probe 22 to a suitable control circuit 26. A second oxygen probe 28 having a leadwire 30 senses the oxygen level at a second point in the system, and does not form a part of the invention. The second oxygen probe 28 may be situated to sense the oxygen content of the molten copper as it exits the tundish, and may be connected to the control circuit 26.

In accordance with the present invention, the control circuit 26 receives the signal from oxygen probe 22 and controls a variable air flow control 32 in accordance with the signal from oxygen probe 22 and the rate of withdrawal of molten metal from the tundish. Since the preferred embodiment of the control system is for use with a copper continuous casting system and further because copper continuous casting systems operate at a fixed speed, this fact may be built into the control circuit 26. If, however, the control system of the invention is used with a continuous casting system which operates at a variable speed, it is necessary to provide a signal to the control circuit which is proportional to the varying rate of withdrawal.

As stated above, the control circuit 26 controls a variable air flow control 32 which may be any suitable adjustable valve. Compressed air is provided to the air flow control 32 and is bubbled into the molten copper by a conventional air lance 34 to which air is supplied by a hose 36. The control circuit 26 may provide a further output to a Display 38 which may provide an indication to the operator of the system of desired quantities such as the percent of oxygen dissolved in the copper entering the tundish (measured by probe 22), the air flow rate, and the percent of oxygen dissolved in the copper exiting the tundish (measured by probe 28).

It has been found that the molten copper 40 located in tundish 14 essentially "picks up" all the oxygen component of air bubbled into it. Thus, the amount of air necessary to correct any oxygen level can be easily calculated. In accordance with the present invention, the control circuit 26 controls the air flow rate into the molten copper in response to the oxygen content of the molten copper entering tundish 14 and the withdrawal rate from the tundish. By way of example and not by way of limitation, the oxygen content of the molten copper entering tundish might be 0.01% by weight. The desired oxygen content by weight for continuous casting might be 0.03% which indicates there is a 0.02% deficiency. If the withdrawal rate from the tundish is 10 tons per hour, the necessary flow rate is 0.0002 × 10 ton/hr or 0.002 tons $O_2$ per hour on a weight basis. Since the "pick up" is essentially 100% and the oxygen percentage of the compressed air is known, the compressed air flow rate can be easily calculated by the control circuit 26.

The control system components may be well known devices. Preferably, the oxygen probes may be the probe disclosed and claimed in copending patent application Ser. No. 723,355 filed Sept. 15, 1976 and assigned to the same assignee as the present invention. Further, the control circuit 26 may be comprised of a differential type amplifier which provides an output which is proportional to the difference in its two input signals, i.e. a signal representing the withdrawal rate and a signal representing the oxygen content of the molten copper entering the tundish. Also, the air flow control 32 may be comprised of a motorized variable valve and the air lance 34 may be a 446 grade ferritic stainless steel tube.

While a preferred embodiment of the invention has been described obvious modifications will occur to those skilled in the art. It is intended, therefore, that the invention be defined in the claims.

I claim:

1. In a continuous casting system for producing an elongated metal rod including a continuous source of molten metal having an oxygen content which is lower than desired, and casting means for continuously withdrawing said molten metal, an automatic system for controlling the oxygen content of the molten metal being withdrawn, comprising:

oxygen content measuring means for providing a signal which is representative of the oxygen content of said molten metal from said source;

oxygen addition means situated intermediate said oxygen content measuring means and said casting means; and control means for controlling the rate oxygen is added to said molten metal by said oxygen addition means in accordance with the signal provided by said oxygen content measuring means and the rate at which metal is withdrawn by said casting means.

2. The automatic system for controlling oxygen content as claimed in claim 1 wherein said casting means withdraws molten metal at a predetermined constant rate.

3. The automatic system as claimed in claim 1 wherein said molten metal is copper.

4. The automatic system as claimed in claim 1, further comprising:

speed measuring means for providing a signal which is representative of the rate at which said molten metal is being withdrawn; and said control means being responsive to the signal provided by said oxygen addition means and said speed measuring means.

5. In a continuous casting system for producing an elongated metal rod including a continuous source of molten metal having an oxygen content which is lower than desired, and casting means for continuously withdrawing molten metal, a method for controlling the oxygen content of said molten metal as it is being withdrawn from said tundish, comprising:

continuously providing a signal which is representative of the oxygen content of said molten metal from said source; and adding oxygen to said molten metal at a rate which is proportioned to the rate of withdrawal of molten metal by said casting mold and the oxygen content of said molten metal from said source.

6. The method is claimed in claim 5 wherein said metal is copper.

* * * * *